US010245463B2

(12) United States Patent
McCarter

(10) Patent No.: US 10,245,463 B2
(45) Date of Patent: Apr. 2, 2019

(54) METHOD AND SYSTEM FOR AN EXERCISE DEVICE

(71) Applicant: Custom Product Innovations, Inc., Lebanon, IL (US)

(72) Inventor: Kyle Lee McCarter, Lebanon, IL (US)

(73) Assignee: Custom Product Innovations, Inc., Lebanon, IL (US)

( * ) Notice: Subject to any disclaimer, the term of this patent is extended or adjusted under 35 U.S.C. 154(b) by 18 days.

(21) Appl. No.: 15/372,084

(22) Filed: Dec. 7, 2016

(65) Prior Publication Data

US 2017/0157453 A1 Jun. 8, 2017

Related U.S. Application Data

(60) Provisional application No. 62/264,095, filed on Dec. 7, 2015.

(51) Int. Cl.

| | |
|---|---|
| ***A63B 21/00*** | (2006.01) |
| ***A63B 23/02*** | (2006.01) |
| ***A63B 21/02*** | (2006.01) |
| ***A63B 21/068*** | (2006.01) |
| *A63B 21/072* | (2006.01) |

(52) U.S. Cl.

CPC ..... *A63B 21/4039* (2015.10); *A63B 21/028* (2013.01); *A63B 21/068* (2013.01); *A63B 23/0205* (2013.01); *A63B 23/0233* (2013.01); *A63B 21/0724* (2013.01); *A63B 21/0726* (2013.01); *A63B 2208/0247* (2013.01); *A63B 2208/0252* (2013.01)

(58) Field of Classification Search

CPC ..... A63B 21/4039; A63B 21/0047; A63B 21/4029; A63B 21/4007; A63B 21/4009; A63B 21/4027; A63B 21/4037; A63B 21/40392; A63B 23/0205

See application file for complete search history.

(56) References Cited

U.S. PATENT DOCUMENTS

| | | | | |
|---|---|---|---|---|
| D463,836 | S | 10/2002 | Herbst | |
| 8,591,388 | B2 | 11/2013 | Jahns | |
| 8,870,727 | B2 | 10/2014 | Palmer | |
| 9,526,939 | B2 * | 12/2016 | Longfellow | A63B 21/068 |
| 2008/0176725 | A1 | 7/2008 | Mehendale | |
| 2011/0207587 | A1 * | 8/2011 | De La Rambelje | A63B 21/00047 482/140 |
| 2013/0198961 | A1 * | 8/2013 | Davis | A47C 7/62 5/648 |
| 2013/0253582 | A1 * | 9/2013 | Tielve | A61H 1/0292 606/240 |

(Continued)

*Primary Examiner* — Megan Anderson

(74) *Attorney, Agent, or Firm* — Armstrong Teasdale LLP

(57) ABSTRACT

An exercise device includes a flat base having a first end and an opposing second end. The base is configured to engage a flat exercise surface. The exercise device further includes a pair of opposing sidewalls extending away from the base and an arcuate upper surface extending between the first end and the second end between the pair of opposing sidewalls. A first angle is defined between the base and the upper surface proximate the first end and a second angle is defined between the base and the upper surface proximate the second end. The exercise device also includes a coccyx cutout in the upper surface proximate at least one of the first end and the second end.

15 Claims, 7 Drawing Sheets

(56) References Cited

U.S. PATENT DOCUMENTS

| | | | | |
|---|---|---|---|---|
| 2014/0113781 | A1* | 4/2014 | McCarter ..... | A63B 23/0205<br>482/140 |
| 2015/0031513 | A1 | 1/2015 | Park | |
| 2015/0111709 | A1 | 4/2015 | Longfellow | |

* cited by examiner

METHOD AND SYSTEM FOR AN EXERCISE DEVICE

CROSS REFERENCE TO RELATED APPLICATIONS

This application claims priority to and the benefit of the filing date of U.S. Provisional Application No. 62/264,095 filed on Dec. 7, 2015, which is hereby incorporated by reference in its entirety.

BACKGROUND

This invention relates generally to exercise equipment and more specifically to exercise devices which strengthen the abdominal muscles (the Rectus Abdominous, The Internal and External Obliques and the Transverse Abdominous), and the lower back muscles.

In general, a muscle is strongest at its mid-range of motion. When human beings stand up straight, the muscles of the torso at the center section of the body, which hold the body upright, are in their strongest position, and allow for functional movement bending forward and backward. Most abdominal exercise programs work the abdominal motions from a flat floor. This only brings into play one half of the motion of the muscles, leaving a large weakness in the muscle itself that could develop into numerous back and hip problems.

The abdominal muscles can work or bend the spine over a range from approximately a 30° extension back through center, or the neutral position, to an approximately 25° flexion forward of the neutral position. The function of the abdominal muscles is to bend the spine. The abdominal muscles are in four segments, each of which corresponds to a vertebra on the back. Therefore, when the top abdominal segment contracts, it bends the third and fifth thoracic vertebrae with a pivot point between them. Then when the second abdominal segment contracts, it bends the fifth and sixth thoracic vertebrae and the pivot point moves down between them and so on, until we reach full spinal flexion.

There is a need for an exercise device which exercises the abdominal muscles over their full range of motion, which makes the abdominal muscles work fully, and which exercises the lower abdominal muscle and the lower back muscles as well as the upper abdominal muscles. There also a need to eliminate discomfort and injury to the exerciser due to rubbing and friction occurring at locations of movement and weight-bearing.

BRIEF DESCRIPTION

In one aspect, an exercise device includes a flat base having a first end and an opposing second end. The base is configured to engage a flat exercise surface. The exercise device further includes a pair of opposing sidewalls extending away from the base and an arcuate upper surface extending between the first end and the second end between the pair of opposing sidewalls. A first angle is defined between the base and the upper surface proximate the first end and a second angle is defined between the base and the upper surface proximate the second end. The exercise device also includes a coccyx cutout in the upper surface proximate at least one of the first end and the second end.

DRAWINGS

These and other features, aspects, and advantages of the present disclosure will become better understood when the following detailed description is read with reference to the accompanying drawings in which like characters represent like parts throughout the drawings, wherein.

Figure 1:
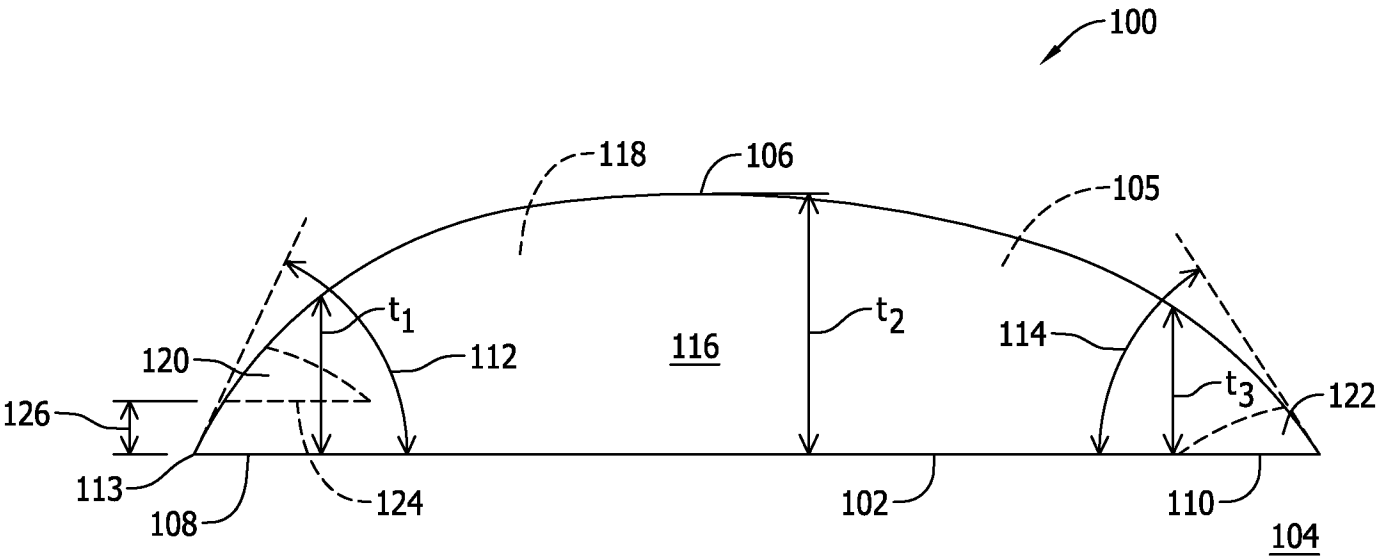
FIG. 1 is a side elevation view of an exercise device in an exemplary embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

Embodiments of an exercise device are described below. In an embodiment, the exercise device includes a flat base including a first end and an opposing second end, the base configured to engage a flat exercise surface, a first inclined surface extending from the first end towards the opposing second end, a second inclined surface extending from the second end towards the first end. The exercise device also includes a central surface approximately midway between the first end and the second end, the central surface configured to join the first inclined surface and the second inclined surface in at least one of an arcuate transition and a linear transition and a notch configured to receive a coccyx area of a user and extending through at least one of the first inclined surface and the second inclined surface. In other embodiments, the inclined surface is inclined with respect to the base at a first angle and the second inclined surface is inclined with respect to the base at a second angle, the first angle different than the second angle. In various embodiments, the first inclined surface is inclined with respect to the base at a first angle and the second inclined surface is inclined with respect to the base at a second angle, the first angle and the second angle are approximately equal. In another embodiment, the first inclined surface is inclined with respect to the base at a first angle and the second inclined surface is inclined with respect to the base at a second angle, the first and second angles in the range of 15° to 60°. The exercise device also includes a pair of opposing sidewalls extending away from the base substantially orthogonally or angled towards each other. In one embodiment, the notch extends through the base and at least one of the first inclined surface and the second inclined surface.

In other embodiments, an abdominal exercise device includes a base configured to engage an exercise surface, such as, but not limited to a floor or a bench. The base includes a first end including a first edge and an opposing second end including a second edge. The abdominal exercise device also includes a pad member coupled to the base. The pad extends from the first edge to the second edge and includes a thickness that varies between the first end to the second end. The pad includes a first notch extending through at least one of the base and the pad member from the first edge toward the second edge. In another embodiment, the base is rigidly flat and/or the thickness is continuously variable between the first end to the second end. In still other embodiments, a second notch extends through at least one of said base and said pad member from said second edge toward said first edge.

Figure 2:
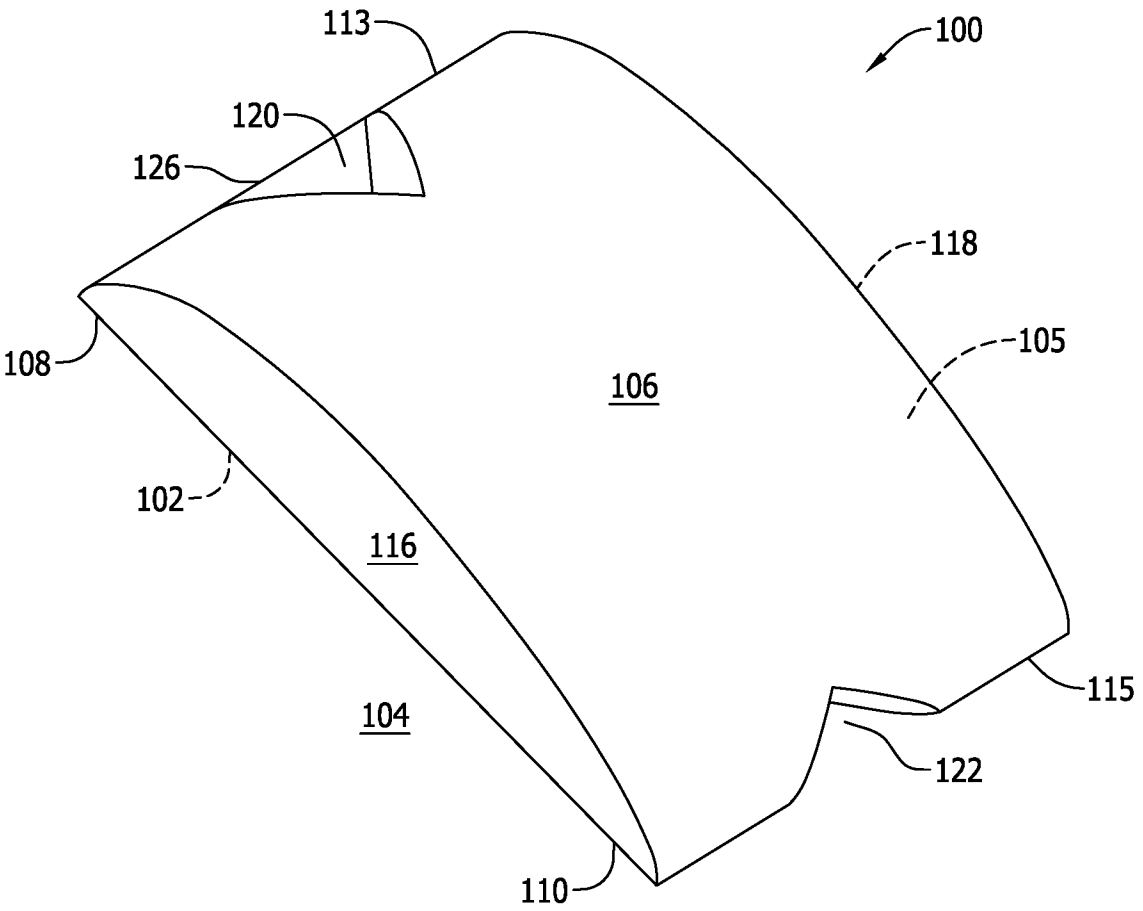
FIG. 2 is a perspective view of the exercise device shown in FIG. 1.

FIG. 1 is a side elevation view of an exercise device 100 in an exemplary embodiment of the present disclosure. FIG. 2 is a perspective view of exercise device 100. In the exemplary embodiment, exercise device 100 includes a flat base 102 configured to engage a flat surface 104 on which an exercise using exercise device 100 is to be performed. Exercise device 100 includes an arcuate upper surface 106 covering a pad member 105 that extends from a first end 108 of base 102 to an opposing second end 110 of base 102. Upper surface 106 meets first end 108 in a first angle 112 at first edge 113 and meets opposing second end 110 in a second angle 114 at a second edge 115. In one embodiment, angles 112 and 114 are equal. In other embodiments, angles 112 and 114 are different. Exercise device 100 includes a first sidewall 116 and an opposite second sidewall 118 extending approximately orthogonally away from base 102. In an embodiment, exercise device 100 includes a first coccyx notch, also referred to herein as a first cutout 120 in upper surface 106 at first end 108. Exercise device 100 may also include a second coccyx notch or a second cutout 122 at opposing second end 110. As shown in the exemplary embodiment of FIG. 1, first coccyx cutout 120 is formed as a depression in upper surface 106, that is, first coccyx cutout 120 does not penetrate all the way through exercise device 100, but rather only extends from upper surface 106 partially though exercise device 100. Accordingly, a bottom surface 124 of first coccyx cutout 120 is spaced a distance 126 from base 102. Also as shown in the exemplary embodiment of FIG. 1, second coccyx cutout 120 is formed as a cutout extending from upper surface 106 through exercise device 100 and base 102. Pad member 105 extends from first edge 113 to second edge 115 and includes a thickness $t_n$ that varies between the first end to the opposing second end.

Figure 3:
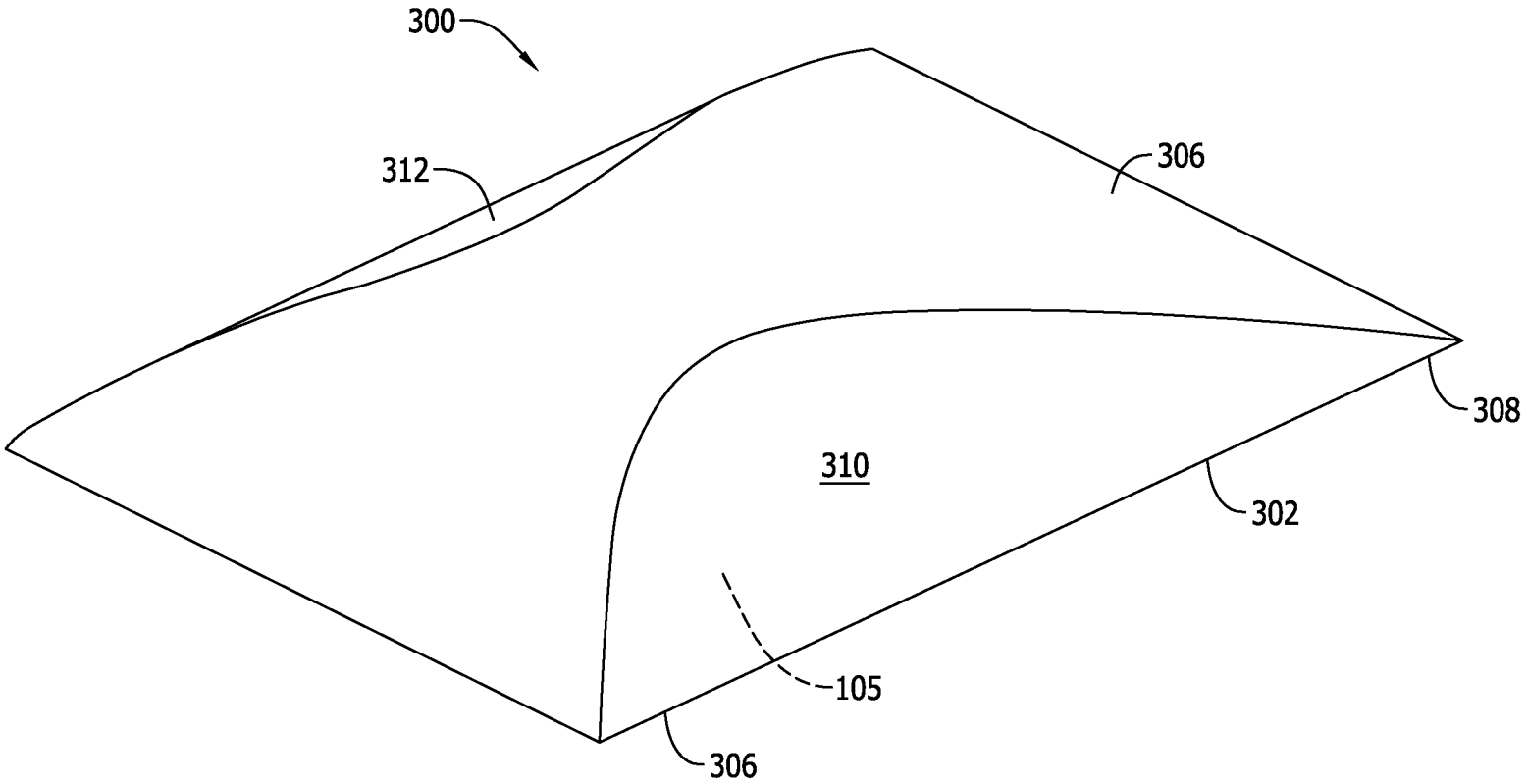
FIG. 3 is a perspective view of an exercise device in accordance with another exemplary embodiment of the present invention.
Figure 4:
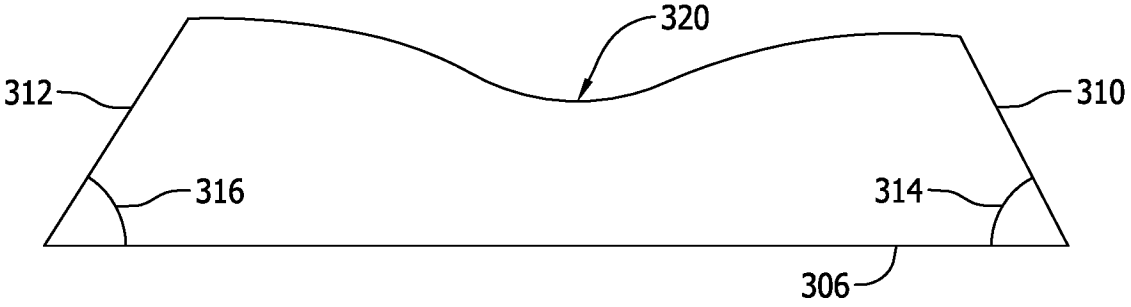
FIG. 4 is a front elevation view of the exercise device shown in FIG. 3.

FIG. 3 is a perspective view of an exercise device 300 in accordance with another exemplary embodiment of the present invention. FIG. 4 is a front elevation view of exercise device 300. In the exemplary embodiment, exercise device 300 includes a base 302 and an arcuate upper surface 304 that extends from a first side 306 of base 302 to a second side 308 of base 302. Exercise device 300 also includes a pair of sidewalls 310 and 312. Sidewalls 310 and 312 are angled inwardly towards each other by a first angle 314 between base 302 and sidewall 310 and by a second angle 316 between base 302 and sidewall 312. In various embodiments, exercise device 300 includes a depression 320 in upper surface 304 in the approximate center of exercise device 300. Depression 320 is sized and configured to receive, a body part of an exerciser, for example, a forearm.

Figure 5:
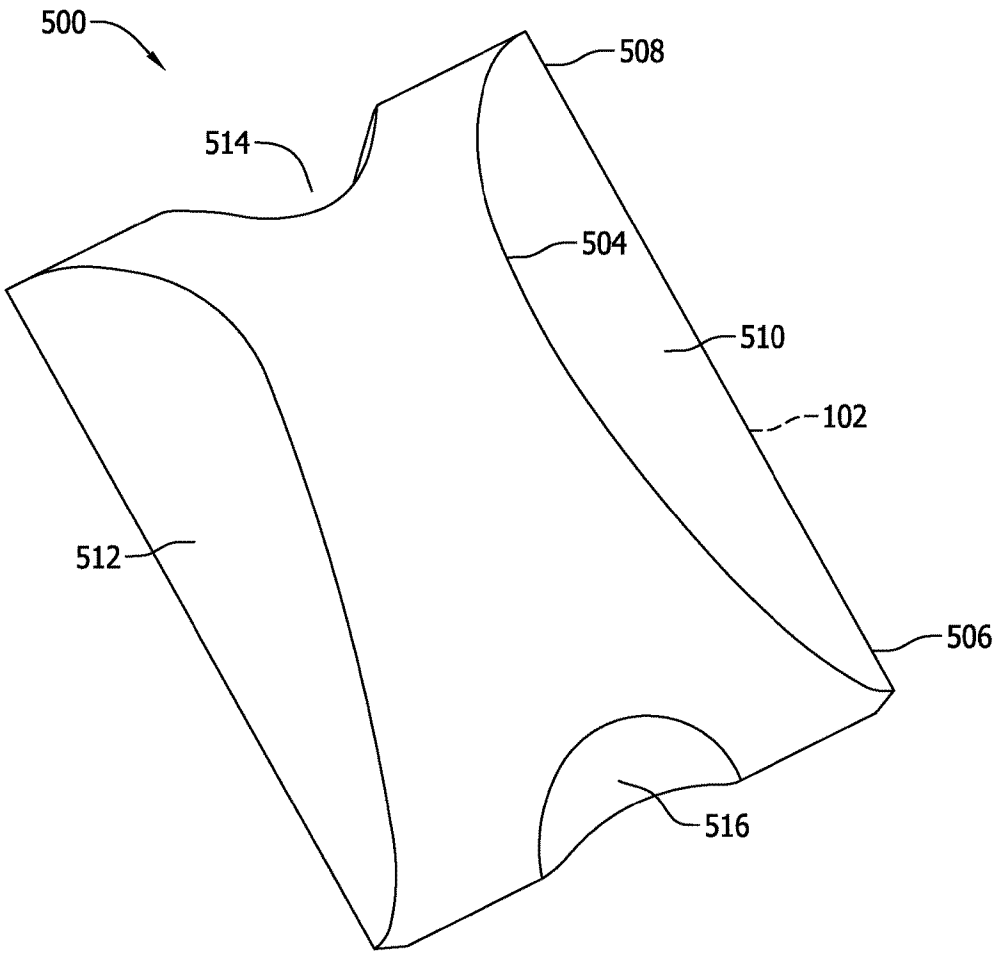
FIG. 5 is a perspective view of an exercise device in accordance with another exemplary embodiment of the present invention.

FIG. 5 is a perspective view of an exercise device 500 in accordance with another exemplary embodiment of the present invention. In the exemplary embodiment, exercise device 500 includes a base 502 and an arcuate upper surface 504 that extends from a first end 506 of base 502 to a second end 508 of base 502. Exercise device 500 includes a pair of inwardly angled sidewalls 510 and 512 similar to sidewalls 310 and 312 described above with respect to FIGS. 3 and 4. Exercise device 500 includes a pair of coccyx cutouts 514 and 516 similar to coccyx cutouts 120 and 122 described above with respect to FIGS. 1 and 2. Inwardly angled sidewalls 510 and 512 are configured to permit a greater range of motion for the external oblique muscles of an exerciser. Coccyx cutouts 514 and 516 are configured to reduce a pressure on the tailbone or coccyx of the exerciser. Typically, exercise devices that exhibit contact of the coccyx of the exerciser with the exercise device also exhibit a problem of rubbing and subsequent injury of the skin over the coccyx or bruising in that area. Instead of cushioning the area of contact with additional padding, which exacerbates the problem, embodiments of the present disclosure eliminate the point of friction and rubbing between the coccyx and exercise device 500.

In the various embodiments of FIGS. 1-5, exercise devices 100, 300, and 500 formed of a resilient lightweight material such as foam rubber or closed cell foam. Alternatively, rubber or elastomeric materials can be used. Angle 112, shown in FIGS. 1 and 2 is selected to be between approximately 35° to approximately 55°. Angle 114, shown in FIGS. 1 and 2 is selected to be between approximately 15° to approximately 35°. Angles 112 and 114 of upper surface 106 are chosen to suit the exerciser. The steeper the angle, the more effort is required by the muscles of the exerciser to perform the exercise. Therefore, for beginners with relatively weak muscles, the incline should be gradual, and for persons with greater muscle strength, the incline should be made steeper. Therefore, the exerciser can place his or her legs at either end of the device depending upon the strength of the muscles of the exerciser and the strenuousness of the exercise desired. In general, angles 112 and 114 can be at any value between 15 and 60 degrees to accommodate the muscular strength of the exerciser.

Figure 6:
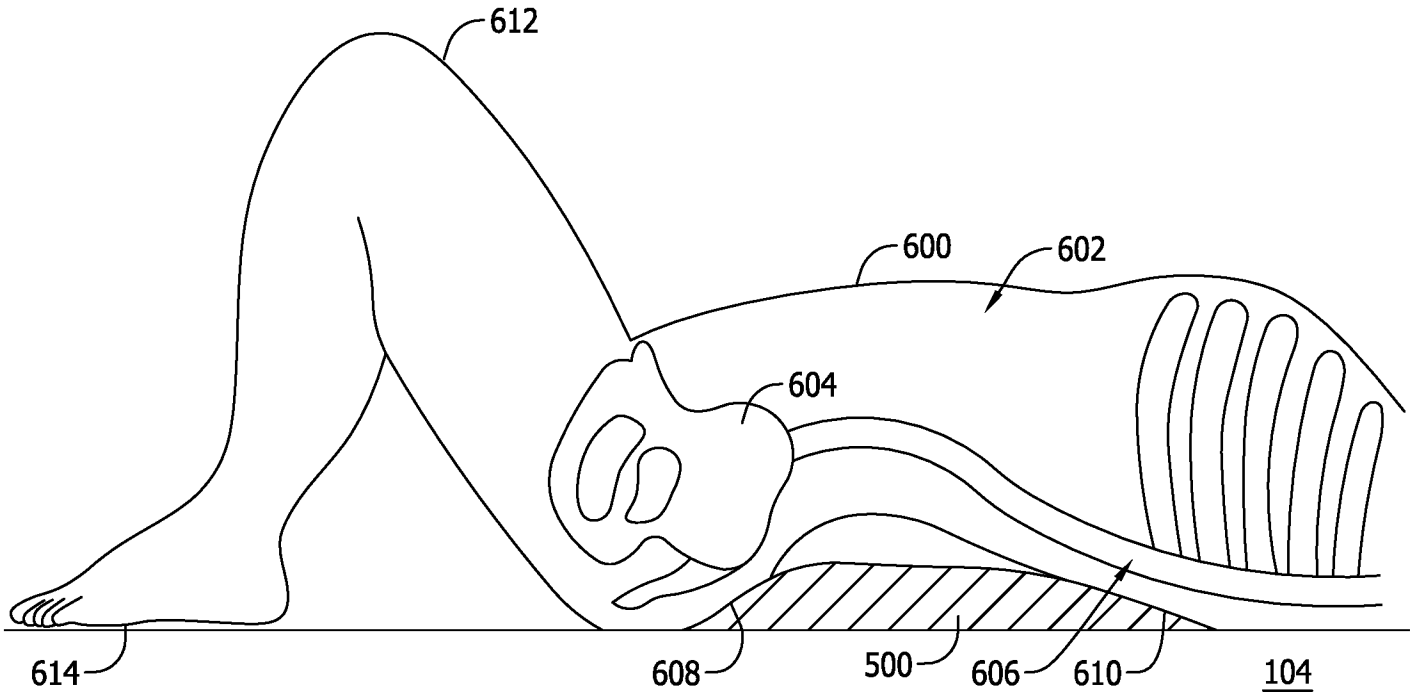
FIG. 6 is a side elevation view of the exercise device shown in FIG. 5 in use by an exerciser.

FIG. 6 is a side elevation view of exercise device 500 in use by an exerciser 600. A position of exerciser 600 on exercise device 500 for exercising upper abdominal muscles 602 is shown. Also shown are a pelvis 604 and a spine 606 of exerciser 600. It should be noted that the placement of a torso of exerciser 600 against a first inclined surface 608 and a second inclined surface 610 bends spine 606 backward and permits a full range of motion as exerciser 600 moves his or her torso upwards by contraction of abdominal muscles 602 against the weight of exerciser 600. Also, as can be seen in FIG. 1, the legs 612 of exerciser 600 are bent with the soles 614 of the feet of exerciser 600 against flat surface 104.

Figure 7:
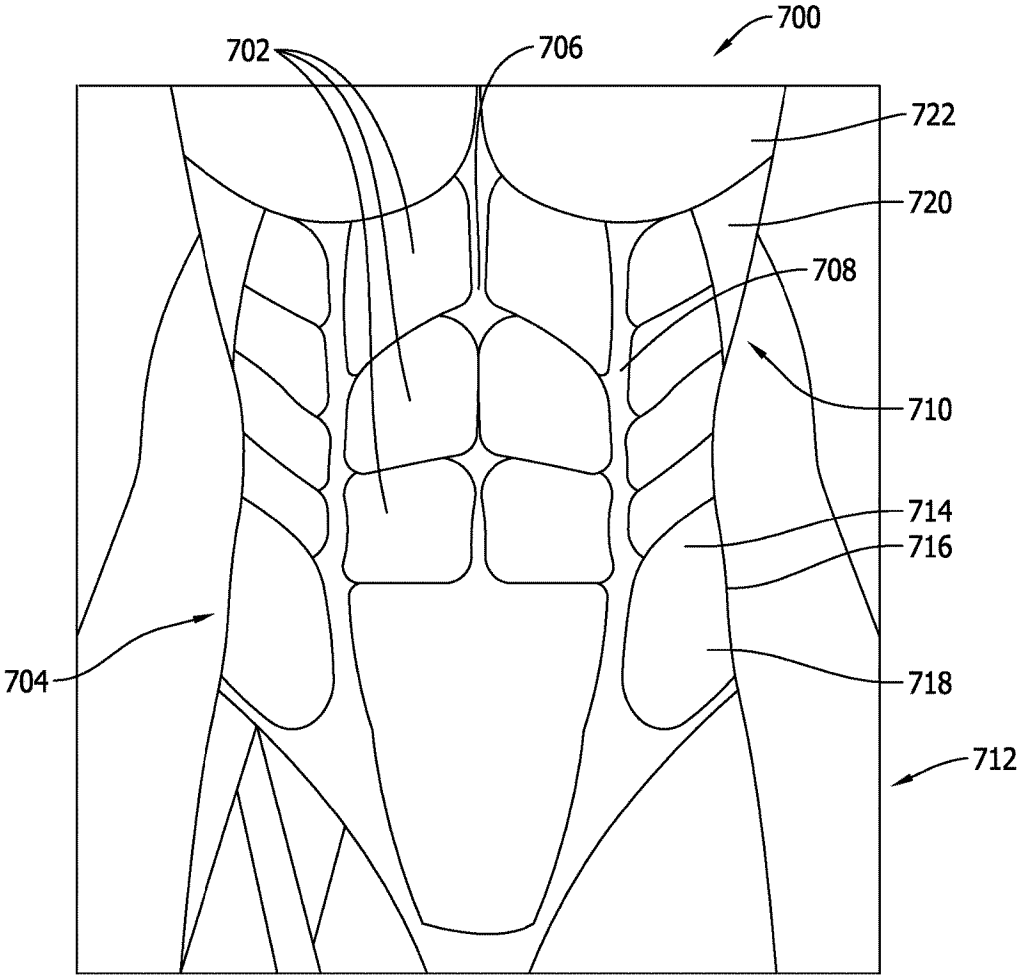
FIG. 7 is a muscle chart of a midsection of a human user of the exercise device shown in FIGS. 1-6.

FIG. 7 is a muscle chart of a midsection 700 of a human user of exercise device (100, 300, 500). Midsection 700 includes a rectus abdominis 702 muscle group. Rectus abdominis 702 is a long flat muscle, which extends along the whole length of a front of an abdomen 704, and is divided into two lateral halves by a linea alba 706. An upper portion 708 is attached principally to cartilage of a fifth rib (not shown). Rectus abdominis 702 is an important postural muscle. It is responsible for flexing the lumbar spine (not shown), as when doing a sit up. A rib cage 710 is brought up towards a pelvis 712 when the pelvis is fixed, or pelvis 712 can be brought towards rib cage 710 (posterior pelvic tilt) when rib cage 710 is fixed, such as in a leg-hip raise. Rib cage 710 and pelvis 712 can also be brought together simultaneously when neither is fixed in space. Rectus abdominis 702 assists with breathing and plays an important role in respiration when forcefully exhaling, as seen after exercise as well as in conditions where exhalation is difficult such as emphysema. It also helps in keeping the internal organs intact and in creating intra-abdominal pressure, such as when exercising or lifting heavy weights, during forceful defecation or parturition (childbirth). Features of exercise device (100, 300, 500) make rectus abdominis 702 work harder.

An external oblique muscle group 714 is situated on a lateral part 716 of abdomen 704 and on an anterior part 718 of abdomen 704. It is a broad, thin, and irregularly quadrilateral muscle group. External obliques 714 function to pull rib cage 710 downwards and compress abdominal cavity 704. It also has limited actions in both flexion and rotation of the vertebral column. One side of the obliques contracting can create lateral flexion. By chamfering the sides of exercise device (100, 300, 500), an ability for external obliques 714 to remain at rest during the exercise creating a balance point along the spinal column requiring stabilization from external obliques 714. Additionally, by utilizing external obliques 714 for greater stabilization in the lateral direction it requires greater exertion from rectus abdominis 702 in the direction vertical direction or along the normal axis of a sit up.

A serratus anterior 720 is a muscle that originates on a surface 722 of the first to eighth ribs at the side of rib cage 710.

An exercise device for exercising and strengthening the upper and lower abdominal muscles and the lower back muscles has been described, which is lightweight and portable, and inexpensive and easy to manufacture. The device isolates the muscles which are to be exercised and provides vigorous exercise to the muscles while reducing an ability to shift the effort of the exercise to other muscles to perform part of the exercise.

Although the use of exercise device 500 has been described wherein the body weight of exerciser 600 provides the force against which the muscles work, to obtain more vigorous exercise, exerciser 600 can use a bar bell, dumb bells, ankle weights or wrist weights to provide greater resistance. Also, the angles of the sloping end sections can be changed to accommodate the strength of the muscles of the exerciser. Exercise device 500 may have only one inclined end section or additional end sections attached to the side walls.

The above-described embodiments of a method and system of an exercise device provide a cost-effective and reliable means for increased range of motion of abdominal exercises, reducing stress and friction points at for example, an exerciser's coccyx, and improving a strenuousness of a plurality of exercise that facilitates matching an exerciser's strength and ability with orientations of the exercise device. More specifically, the methods and systems described herein facilitate exercising the abdominal oblique muscles. In addition, the above-described methods and systems facilitate reducing contact between the exercise device and the exerciser's coccyx. As a result, the methods and systems described herein facilitate exercising the abdominal muscles in a cost-effective and reliable manner.

Exemplary embodiments of exercise devices are described above in detail. The exercise devices, and methods of operating such devices are not limited to the specific embodiments described herein, but rather, components of the devices and/or steps of the methods may be utilized independently and separately from other components and/or steps described herein. For example, the methods may also be used in combination with other systems requiring isolation of particular muscle groups or increased range of motion during an exercise, and are not limited to practice with only the systems and methods as described herein. Rather, the exemplary embodiment can be implemented and utilized in connection with many other exercise devices that are currently configured to increase resistance while using the exercise device.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An exercise device comprising:

a flat base comprising a first end and an opposing second end, said flat base configured to engage a flat exercise surface;

a pair of opposing sidewalls extending away from said flat base;

an arcuate upper surface extending between a first edge of said first end and a second edge of said opposing second end between said pair of opposing sidewalls, a first angle defined between said flat base and said upper surface proximate said first end, a second angle defined between said flat base and said upper surface proximate said opposing second end; and a first coccyx cutout in said upper surface proximate said first end and extending to said first edge, and a second coccyx cutout in said upper surface proximate said opposing second end and extending to said second edge, wherein said first coccyx cutout extends completely through said exercise device and said second coccyx cutout extends only partially through said exercise device.

2. The exercise device of claim 1, wherein said first angle being different than said second angle.

3. The exercise device of claim 1, wherein said first angle and said second angle are equal.

4. The exercise device of claim 1, wherein said first and second angles are in a range of 15° to 60°.

5. The exercise device of claim 1, wherein said pair of opposing sidewalls extends away from said flat base substantially orthogonally.

6. The exercise device of claim 1, wherein said pair of opposing sidewalls extends away from said flat base angled towards each other.

7. An exercise device comprising:

a flat base comprising a first end and an opposing second end, said flat base configured to engage a flat exercise surface;

a first inclined surface extending from said first end towards said opposing second end;

a second inclined surface extending from said opposing second end towards said first end;

an upper surface approximately midway between said first end and said opposing second end, said upper surface configured to join said first inclined surface and said second inclined surface in at least one of an arcuate transition and a linear transition; and a first coccyx cutout configured to receive a coccyx area of a user and extending through said first inclined surface and a second coccyx cutout extending through said second inclined surface;

the first coccyx cutout in said upper surface proximate said first end and extending to said first edge, and the second coccyx cutout in said upper surface proximate said opposing second end and extending to said second edge, wherein said first coccyx cutout extends completely through said exercise device and said second coccyx cutout extends only partially through said exercise device.

8. The exercise device of claim 7, wherein said first inclined surface is inclined with respect to said flat base at a first angle and said second inclined surface is inclined with respect to said flat base at a second angle, said first angle different than said second angle.

9. The exercise device of claim 7, wherein said first inclined surface is inclined with respect to said flat base at a first angle and said second inclined surface is inclined with respect to said flat base at a second angle, said first angle and said second angle are equal.

10. The exercise device of claim 7, wherein said first inclined surface is inclined with respect to said flat base at a first angle and said second inclined surface is inclined with respect to said flat base at a second angle, said first and second angles in a range of 15° to 60°.

11. The exercise device of claim 7, further comprising a pair of opposing sidewalls extending away from said flat base substantially orthogonally.

12. The exercise device of claim 7, further comprising a pair of opposing sidewalls extending away from said flat base angled towards each other.

13. An abdominal exercise device comprising:

a base configured to engage an exercise surface, said base comprising a first end comprising a first edge and an opposing second end comprising a second edge;

a pad member coupled to said base, said pad member extending from said first edge to said second edge, said pad member comprising a thickness that varies between said first end to said opposing second end; and a first coccyx cutout extending through said pad member from said first edge toward said second edge and a second coccyx cutout extending through said pad member from said second edge toward said first edge, and wherein the first coccyx cutout extends completely through said abdominal exercise device and said second coccyx cutout extends only partially through said abdominal exercise device.

14. The abdominal exercise device of claim 13, wherein said base is rigidly flat.

15. The abdominal exercise device of claim 13, wherein said thickness is continuously variable between said first end to said opposing second end.

* * * * *